US007444996B2

(12) United States Patent
Potier

(10) Patent No.: US 7,444,996 B2
(45) Date of Patent: Nov. 4, 2008

(54) FUEL VAPOUR STORAGE AND RECOVERY APPARATUS WITH HEAT EXCHANGER

(75) Inventor: Vincent Potier, Brussels (BE)

(73) Assignee: Inergy Automotive Systems Research (Societe Anonyme), Bruxelles (BG)

( * ) Notice: Subject to any disclaimer, the term of this patent is extended or adjusted under 35 U.S.C. 154(b) by 0 days.

(21) Appl. No.: 11/572,374

(22) PCT Filed: Jul. 19, 2005

(86) PCT No.: PCT/EP2005/053492

§ 371 (c)(1),
(2), (4) Date: Feb. 22, 2007

(87) PCT Pub. No.: WO2006/008301

PCT Pub. Date: Jan. 26, 2006

(65) Prior Publication Data

US 2007/0251511 A1 Nov. 1, 2007

(30) Foreign Application Priority Data

Jul. 22, 2004 (EP) ..... 04103507

(51) Int. Cl.
*F02M 33/02* (2006.01)
*F02G 5/00* (2006.01)

(52) U.S. Cl. ..... 123/519; 123/520; 123/543

(58) Field of Classification Search ..... 123/516, 123/518, 519, 520, 521, 543, 557; 280/832
See application file for complete search history.

(56) References Cited

U.S. PATENT DOCUMENTS 3,093,124 A 6/1963 Wentworth
3,221,724 A 12/1965 Wentworth
3,757,753 A 9/1973 Hunt
4,598,686 A 7/1986 Lupoli et al.
4,721,846 A 1/1988 Lupoli et al.
4,778,495 A 10/1988 Bishop et al.
4,829,968 A 5/1989 Onufer
4,846,135 A 7/1989 Tiphaine
4,864,103 A 9/1989 Bishop et al.
4,909,530 A * 3/1990 Tsukada et al. ..... 180/296
5,021,071 A 6/1991 Reddy (Continued)

FOREIGN PATENT DOCUMENTS

DE 41 40 090 6/1993

(Continued)

*Primary Examiner*—Stephen K. Cronin
*Assistant Examiner*—J. Page Hufty
(74) *Attorney, Agent, or Firm*—Oblon, Spivak, McClelland, Maier & Neustadt, P.C.

(57) ABSTRACT

A fuel vapor storage and recovery apparatus for a fuel system of a motor vehicle including an internal combustion engine with an exhaust pipe and a fuel tank containing a fuel vapor/air mixture above a liquid fuel, the exhaust pipe being close to the fuel tank. The apparatus includes a vapor storage canister including a fuel vapor adsorbent material therein, a thermal insulation mechanism for thermally insulating at least a portion of the fuel tank from the heat generated by the exhaust pipe, and a beat exchanger. The heat exchanger is configured to heat to a purge temperature air guided there through by absorbing heat from the thermal insulation mechanism.

12 Claims, 3 Drawing Sheets

U.S. PATENT DOCUMENTS

| | | | | |
|---|---|---|---|---|
| 5,054,453 | A | | 10/1991 | Onufer |
| 5,207,734 | A | * | 5/1993 | Day et al. ..... 60/278 |
| 5,592,922 | A | | 1/1997 | Denz |
| 5,702,125 | A | | 12/1997 | Nakajima et al. |
| 6,098,601 | A | | 8/2000 | Reddy |
| 6,122,908 | A | | 9/2000 | Wirmark |
| 6,230,693 | B1 | | 5/2001 | Meiller et al. |
| 6,698,403 | B2 | | 3/2004 | Honda et al. |
| 2006/0174857 | A1 | | 8/2006 | Potier et al. |
| 2007/0051345 | A1 | | 3/2007 | Potier |

FOREIGN PATENT DOCUMENTS

| | | |
|---|---|---|
| EP | 0 905 368 | 3/1999 |
| GB | 2 329 217 | 3/1999 |

* cited by examiner

FUEL VAPOUR STORAGE AND RECOVERY APPARATUS WITH HEAT EXCHANGER

BACKGROUND OF THE INVENTION

1. Field of the invention

The invention relates to a fuel vapour storage and recovery apparatus for the fuel system of a motor vehicle comprising a vapour storage canister containing adsorbent material, which is intended to trap and store vapours from the vehicle's fuel tank, and to purge stored vapour and condensate during operation of the vehicle's engine.

2. Discussion of the Background

Fuel vapour escaping from the fuel system is a source of hydrocarbon emission from the automobile. In particular, gasoline vapours may escape from the external vents of the fuel tank, either while driving or while at rest. Within the past several years a number of attempts have been made to limit the escape of gasoline into the atmosphere.

There have been proposed evaporative emission control systems that involve the use of charcoal-filled canisters which are connected, through vapour lines, to the fuel tanks such that gasoline vapours from the tanks are channelled into the canisters, and adsorbed or partially condensed in the charcoal. The vapour line in such a system is connected to an inlet port located at the top of the canister. A second port on the canister is also provided, known as a "purge" port, from which a line extends to the intake manifold or carburettor of the vehicle's engine. When the engine is running, at a preset frequency, condensed fuel and vapour that is stored in the charcoal is released and sucked into the engine, to be burned.

A major problem with evaporative emission control systems of the type employing activated carbon or activated charcoal as adsorbent materials housed in a vapour canister, is that under conditions of low ambient temperature, the fuel that has been adsorbed exhibits a reluctance to be released and purged from the canister. It has been determined that with adsorptive substances currently being employed, satisfactory release of the stored fuel will occur at room temperatures and above; however, when the temperatures fall much below these values, the efficiency of the system suffers significantly. The ability of the carbon to release the fuel is poor until the canister temperature rises.

Therefore, evaporative emission control systems have been proposed in which the temperature of the adsorbent material is regulated by an electrical heating system. In this regard it can be referred e.g. to U.S. Pat. No. 4,598,686, U.S. Pat. No. 4,721,846, U.S. Pat. No. 4,778,495, U.S. Pat. No. 4,864,103, U.S. Pat. No. 6,230,693, EP-A 905 368 and GB 2 329 217. However, electrical heating systems are disadvantageous as they require costly technical equipment and additional energy consumption.

Alternatively, it has been proposed to control the temperature of the adsorbent material by the waste heat produced by the internal combustion engine. Accordingly, evaporative emission control systems have been developed in which the vapour storage canister is located in the proximity of the engine, i.e. in the engine compartment. Other systems rely on passively heating the adsorbent material by hot air which has absorbed heat from the engine before it enters the vapour storage canister. Various heat sources for heating the air have been proposed among which the engine itself, the cooling water circuit and the engine exhaust system. In this regard it can be referred to e.g. U.S. Pat. No. 3,093,124, U.S. Pat. No. 3,221,724, U.S. Pat. No. 3,757,753, U.S. Pat. No. 4,829,968, U.S. Pat. No. 4,846,135, U.S. Pat. No. 5,054,453, U.S. Pat. No. 6,098,601 and U.S. Pat. No. 6,698,403.

In the evaporative emission control systems of the prior art, however, the air for purging the fuel vapour adsorbent material is heated in the proximity of the exhaust pipe, the cooling water circuit or the engine compartment and is then conducted to the adsorbent material. Since it is disadvantageous and possibly dangerous to conduct the fuel vapours over a long distance, usually the fuel vapour adsorbent material is in a container which is close to the fuel tank or is an integral part of the fuel tank, which is generally far away from the heat source. Therefore, the hot air must be conducted from the heat source to the adsorbent material which is close to the fuel tank over a long distance. This requires a complex and space consuming conduit system. Furthermore, the relatively long conduit must be properly insulated in order to avoid significant cooling of the hot air until it reaches the adsorbent material.

On the other hand, fuel systems are known wherein the fuel tank is close to the exhaust pipe and protected from the heat radiation emitted there from by means of a heat shield. Said heat shield is located between the fuel tank and the exhaust pipe in order to avoid heating of the fuel tank and of the fuel contained in the fuel tank above a certain temperature.

SUMMARY OF THE INVENTION

The present invention is based on the idea that the heat shield can advantageously be used to locate an air heater, i.e. a heat exchanger in its proximity to use the captured heat and even, to help reducing the temperature of the part of the fuel tank close to the exhaust pipe. The heat emitted from the heat source to the heat shield (or the temperature of the heat shield) suffices to heat air guided through the heat exchanger. The heat exchanger may be located above the heat shield (close to the tank), integrated to surface of the heat shield or even be located below the heat shield (close to the exhaust pipe) since its surface usually still has a temperature of up to about 150° C. and thus, between the heat shield and the fuel tank, the air may be heated to a temperature of about 100° C. or above, depending on the individual design of the fuel vapour storage and recovery apparatus. Furthermore, the heat exchanger assists the heat shield in blocking heat which is emitted from the exhaust pipe and absorbed by the fuel tank.

In conventional fuel systems comprising such heat shields, the space around the heat shield is generally empty, while according to the present invention, this space is now usefully used.

A system using said space and taking profit of it for heating the canister during purging has been described in DE 4140090. However, in that system, the canister itself is located near to the exhaust pipe and plays the role of heat shield and heat exchanger. Such a system has the drawback of presenting bad adsorption performances when the engine is running, because it is permanently heated then and that fuel vapours rather tend to desorb when temperature rises (see above).

Accordingly, the present invention concerns a fuel vapour storage and recovery apparatus for the fuel system of a motor vehicle having an internal combustion engine with an exhaust pipe and a fuel tank containing a fuel vapour/air mixture above a liquid fuel, the exhaust pipe being close to the fuel tank, said apparatus comprising:

- a vapour storage canister having a fuel vapour adsorbent material therein,
- thermal insulation means for thermally insulating at least a portion of the fuel tank from the heat generated by the exhaust pipe, and
- a heat exchanger, wherein the heat exchanger is adapted to heat to a purge temperature air guided there through by absorbing heat from the thermal insulation means and wherein the canister is a piece separate from the heat exchanger and/or thermal insulation means, located away from the exhaust pipe.

According to the invention, the fuel tank is a hollow body made of a material which does not withstand high temperatures (typically above 80° C.) for a long time without being thermally insulated. The invention gives good results with fuel tanks made of polymeric material. The polymeric material is preferably selected from the group consisting of polyethylene, polyethylene terephthalate, polybutylene terephthalate, polyamide, polyoxymethylene, polypropylene, elastomers and mixtures of two or more thereof. Preferably, the polymeric material comprises high density polyethylene (HDPE). In a specific embodiment, the hollow element also comprises a layer of barrier material like EVOH (at least partially hydrolysed ethylene—vinyl acetate copolymers). Alternatively, the HDPE may be surface treated (by fluorination, sulphonation or the like) in order to reduce its permeability to fuel.

The fuel vapour adsorbent material inside the canister of the apparatus according to the invention can be any absorbent. It is preferably charcoal, either pure, granular, pelletized or supported on an adequate support. It may also be agglomerated charcoal in the form of a honeycomb for instance. According to the invention, the canister is located away from the exhaust pipe in order to avoid its permanent heating in service, when the engine is running. By "away" is meant located at a distance of at least 10 cm from it and/or isolated from it through heat insulation means. Heating of the canister is only allowed during purge cycles, when heated air is flowing through it.

According to the invention, the exhaust pipe from the engine is located close to the fuel tank. This typically means at a few centimetre of the fuel tank (generally less than 10 cm).

The heat insulating means used to insulate the fuel tank from the heat emitted by the exhaust pipe may be of any shape and of any material suitable for the function of heat absorption. Preferably, its shape is adapted to the location where it has to fit. As to the material, it is generally metal. Most heat insulating means used in that field are in the form of a metal heat shield. The metal is preferably aluminium or aluminized steel.

As to the heat exchangers that can be used according to the invention, the pathway for the air flowing through them is preferably designed in a way such that the heating of this air through the walls of the exchanger is promoted. Preferably, this air pathway has the form of a serpentine.

The present invention also concerns a fuel tank system comprising a fuel tank and a fuel vapour storage and recovery apparatus as described above.

For the efficient working and compact design of this system, the heat exchanger must be located close to the heat insulating means. Therefore, preferably, the heat exchanger is located either between the fuel tank and the thermal insulation means, on (i.e. integrated to) the thermal insulation means or between the fuel tank and the exhaust pipe.

The fuel tank system according to the invention generally comprises a conduit system for connecting all its elements together and with the outside of the system (the atmosphere) on one end, and the engine on the other end. Preferably, such a conduit system comprises:

a first conduit means (a) to conduct the fuel vapour/air mixture from the fuel tank to the vapour storage canister;

a second conduit means (b) to conduct the hot air from the heat exchanger to the vapour storage canister in order to heat the adsorbent material to a purge temperature above an ambient temperature in the fuel tank, at which purge temperature the adsorbed fuel vapour fraction of the fuel vapour/air mixture vaporizes and fills the vapour storage canister with hot fuel vapour;

a third conduit means (c) to conduct fresh air from the outside to the heat exchanger; and a fourth conduct means (d) to conduct the hot fuel vapour from the canister to the internal combustion engine so that the hot fuel vapour is combusted therein.

Such systems generally also include a control valve operated by an electronic control module (ECM) which, according to a preset program, opens the fourth conduits means (d) so that the vacuum present in the engine air intake system sucks fresh air into the third conduit means (c), which air passes through the heat exchanger and then through second conduit means (b) to the vapour storage canister to heat the adsorbent material to the purge temperature and vaporize the absorbed fuel vapours, which are finally burned (combusted) by the engine. According to the same preset program, the ECM then closes the control valve.

Generally, such systems also include a vent port. It is namely so that when the fuel vapour/air mixture coming from the fuel tank passes through the canister, it is separated, i.e. only the fuel vapour is absorbed on the absorbent while the air is not. Since this air is clean, it can be sent back to the atmosphere, which is done through the vent port. Therefore, the conduit system may also includes a second control valve that either communicates the vapour storage canister with the exterior of the system (atmosphere) through a vent port or communicates the vapour storage canister with the heat exchanger through the second conduit means (b), said control valve also being operated by the ECM. Such a valve is not necessarily required since the system will work even if the canister communicates all the time with the second conduit means (b). However, the presence of such a valve avoids pressure drops in the second and third conduit means (b and c) when there is no purge taking place.

Both control valves can be operated from the same signal coming from the ECM, and can even share part of their physical embodiment, for instance the same actuator.

BRIEF DESCRIPTION OF THE DRAWINGS

The present invention is illustrated in a non limitative way by FIGS. 1 to 5, which each illustrate a specific embodiment of the present invention.

DETAILED DESCRIPTION OF THE PREFERRED EMBODIMENTS

Figure 1:
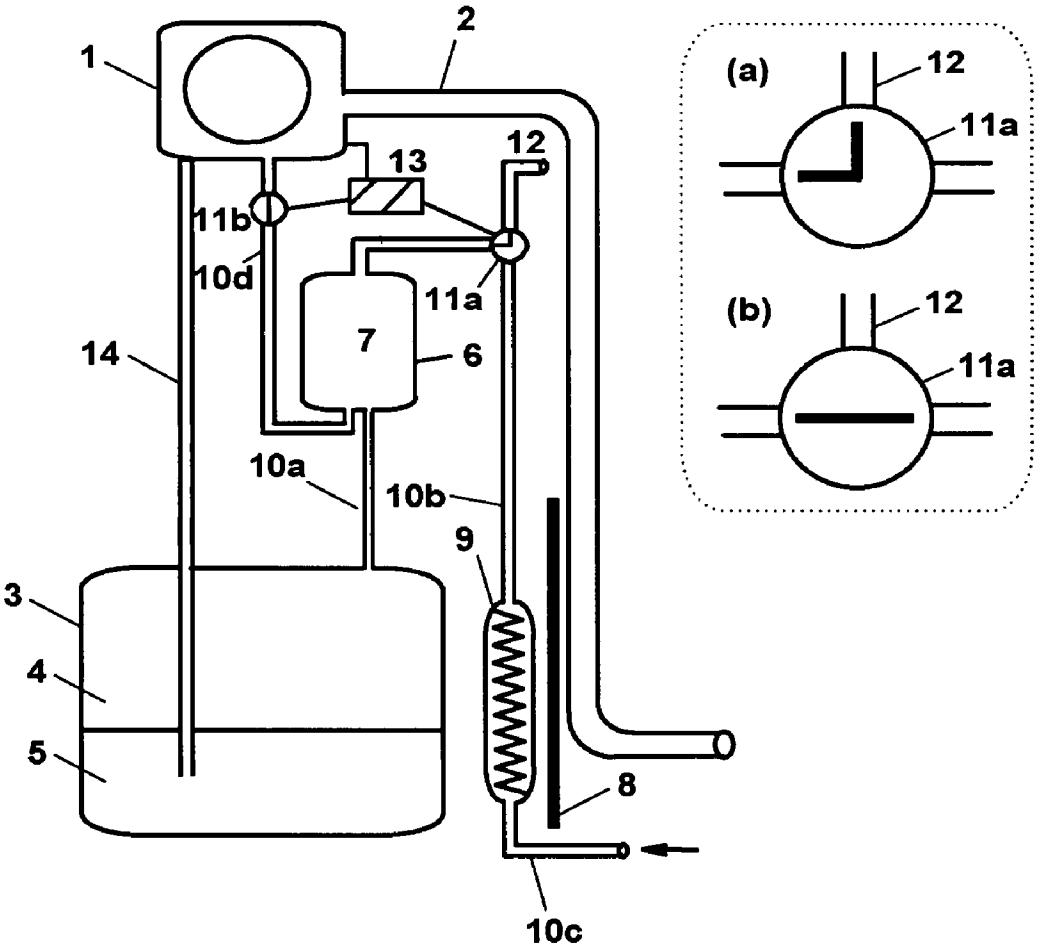

FIG. 1 shows a schematic view of a preferred embodiment of the evaporative emission control system of the invention. A motor vehicle, not shown, includes a fuel tank (3) having a variable volume of liquid fuel (5) therein, e.g. gasoline and/or methanol and a variable volume of fuel vapour/air mixture (4) above the liquid fuel (5). Liquid fuel (5) is delivered from the fuel tank (3) to an internal combustion engine (1) or a fuel processor of a fuel cell through a fuel delivery pipe (14).

The system includes a vapour storage canister (6) having therein a body of fuel vapour adsorbent material (7) such as activated carbon granules. The vapour storage canister (6) communicates with the fuel tank (3) above the liquid fuel (5) therein through a vapour conduit (10*a*).

A first control valve (11*a*) communicates the vapour storage canister (6) either with the exterior of the system through an open vent port (12) (position a), or with a heat exchanger (9) through a vapour/purge conduit (10*b*) (position b). Another control valve (11*b*) either opens or closes a conduit (10*d*) leading to the engine air intake system. Both control valves (11*a* and 11*b*) are operated by an electronic control module ("ECM") (13) on the motor vehicle.

The heat exchanger (9) is located in the proximity of an exhaust pipe (2) of the internal combustion engine (1). Between the heat exchanger (9) and the exhaust pipe (2) there is located a thermal insulation means (8) preventing the fuel tank (3) from absorbing to much heat radiation which is emitted from the exhaust pipe (2).

During normal operation (either when the internal combustion engine (1) is turned on or off), control valve (11*a*) opens the vent port (12) which is in communication with the vapour storage canister (6) and the pressure gradient between the fuel tank (3) and the exterior of the system expels a fraction of the fuel vapour/air mixture (4) from the fuel tank (3) into the vapour storage canister (6) through the vapour conduit (10*a*). The pressure gradient may be attributable to a thermally induced increase in the concentration of vapour in the fuel vapour/air mixture (4) or to the entry of new fuel into the fuel tank (3) during refuelling. In either circumstance, the fuel vapour/air mixture (4) expelled through the vapour/purge conduit (10*a*) circulates toward the vent port (12) through the body of adsorbent material (7) in the vapour storage canister (6). During such circulation, the fuel vapour fraction of the fuel vapour/air mixture (4) collects on the adsorbent material (7) as liquid fuel in the pores of the adsorbent material (7) while the air fraction of the mixture escapes through the vent port (12) so that substantially no fuel vapour is released to the exterior of the system and the atmosphere.

When the engine is running, in order to initiate a purge and according to a given program, the ECM (13) causes control valve (11*a*) to switch from position (a) to position (b) and opens control valve (11*b*). By doing so, the engine (1) sucks fresh air from the outside of the system through heat exchanger (9) using an air inlet (10*c*). The exterior wall of the heat exchanger (9) which faces the exhaust pipe (2) and the thermal insulation means (8) continuously absorbs heat radiation emitted from the exhaust pipe (2) through the thermal insulation means (8). Said absorption causes said exterior wall of the heat exchanger (9) to increase its temperature. Within the heat exchanger (9) the air passes the hot surface of the exterior wall thereby absorbing heat from the heat exchanger (9). After having passed the heat exchanger (9) hot air having a temperature significantly above the ambient temperature within the fuel tank (3) enters the vapour storage canister (6) through vapour/purge conduit (10*b*) and control valve (11*a*). The hot air causes the adsorbent material (7) within the vapour storage canister (6) to absorb heat until it reaches a temperature which is also significantly above the ambient temperature within the fuel tank (3). The heating of the adsorbent material (7) facilitates desorption of the fuel trapped in the pores. Thus, the liquid fuel in the pores of the adsorbent material (7) is converted to a large volume of gaseous hot vapour which fills the vapour storage canister (6). The hot fuel vapour which has been desorbed from the adsorbent material (7) within the vapour storage canister (6) is then directed to the internal combustion engine (1) through control valve (11*b*) and conduit (10*d*). Valves (11*a*) and (11*b*) share the same signal and the same actuator.

After the purge is completed, control valve (11*a*) switches again to its position (a) and control valve (11*b*) closes again, this until the next purge. By doing so and by locating the canister (6) away from the exhaust pipe (2) as illustrated, heating of said canister outside the purge periods is prevented and better adsorption performances are reached.

Figure 3:
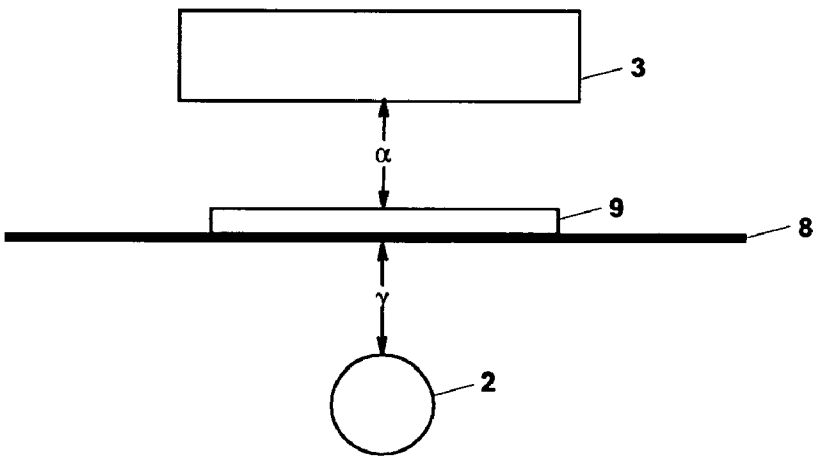
Figure 2:
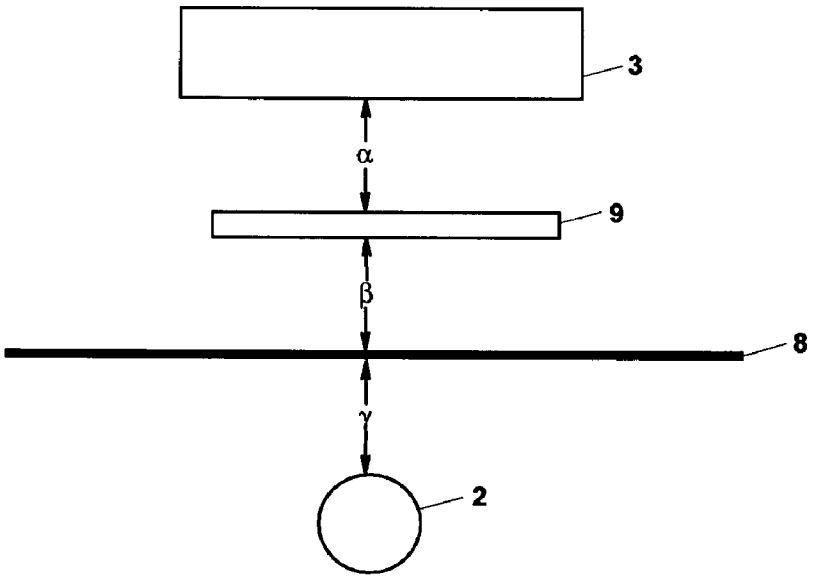
Figure 4:
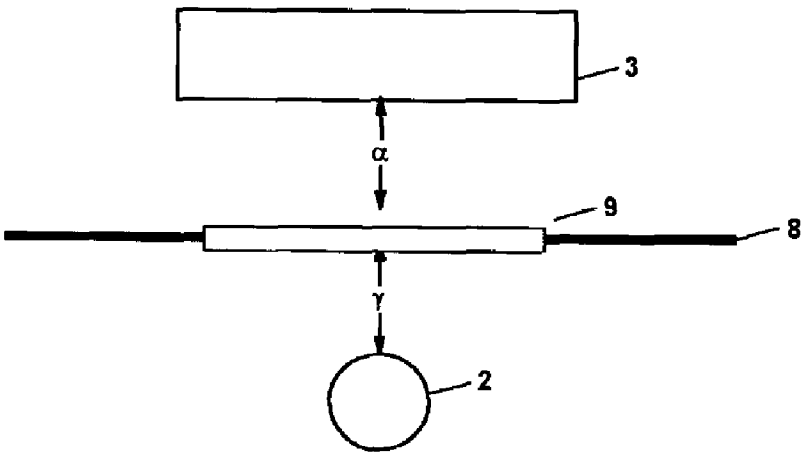

FIGS. 2 to 4 show a schematic cross-sectional view of the relative arrangement of the exhaust pipe (2), the fuel tank (3), the thermal insulation means (8) and the heat exchanger (9).

According to the preferred embodiment depicted in FIG. 2 the fuel tank (3) is spaced from the heat exchanger (9) by a minimal distance $\alpha$, the heat exchanger (9) is spaced from the thermal insulation means (8) by a minimal distance $\beta$ and the thermal insulation means (8) is spaced from the exhaust pipe (2) by a minimal distance $\gamma$.

According to the preferred embodiment depicted in FIG. 3 the minimal distance $\beta$ between the thermal insulation means (8) and the heat exchanger (9) approaches zero, i.e. the thermal insulation means (8) is in intimate contact with the heat exchanger (9) so that both elements share a common wall.

Figure 5:
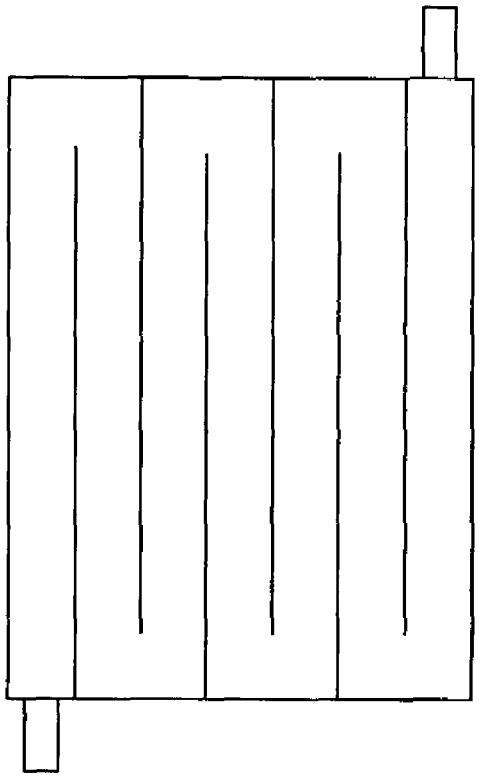

In the preferred embodiment shown in FIG. 4, the thermal insulation means (8) and the heat exchanger (9) are integrally formed. FIG. 5 shows a schematic top view of a preferred embodiment of the heat exchanger (9) according to which the air pathway has the form of a serpentine.

The invention claimed is:

1. A fuel vapor storage and recovery apparatus for a fuel system of a motor vehicle including an internal combustion engine with an exhaust pipe and a fuel tank containing a fuel vapor/air mixture above a liquid fuel, the exhaust pipe being close to the fuel tank, the apparatus comprising:

a vapor storage canister including fuel vapor adsorbent material therein;

thermal insulation means for thermally insulating at least a portion of the fuel tank from heat generated by the exhaust pipe;

a heat exchanger, and means for supplying air from said heat exchanger to said vapor storage canister, wherein the heat exchanger is configured to heat to a purge temperature air guided there through by absorbing heat from the thermal insulation means, and wherein the canister is a piece separate from the heat exchanger and/or thermal insulation means, and the canister is located away from the exhaust pipes, wherein the heat exchanger is either located between the fuel tank and the thermal insulation means, or integrated to the thermal insulation means.

2. The apparatus according to claim 1, wherein the thermal insulation means includes a metal heat shield.

3. The apparatus according to claim 1, wherein the heat exchanger includes an air pathway in a form of a serpentine.

4. The fuel tank system according to claim 1, the fuel tank comprising a conduit system that includes:

a first conduit means to conduct the fuel vapor/air mixture from the fuel tank to the vapor storage canister;

a second conduit means to conduct hot air from the heat exchanger to the vapor storage canister to heat the adsorbent material to a purge temperature above an ambient temperature in the fuel tank at which purge temperature an adsorbed fuel vapor fraction of the fuel vapor/air mixture vaporizes and fills the vapor storage canister with hot fuel vapor;

a third conduit means to conduct fresh air from outside to the heat exchanger; and a fourth conduit means to conduct the hot fuel vapor from the canister to the internal combustion engine so that the hot fuel vapor is combusted therein.

5. The fuel tank system according to claim 4, wherein the conduit system further includes a first control valve operated by an electronic control module.

6. The fuel tank system according to claim 5, wherein the conduit system further includes a second control valve that either communicates the vapor storage canister exterior of the system through a vent port or communicates the vapor storage canister with the heat exchanger through one of the conduit means, the second control valve also being operated by the electronic control module.

7. The fuel tank system according to claim 6, wherein both first and second control valves share a same signal coming from the electronic control module.

8. The apparatus according to claim 1, wherein the heat exchanger is located between the fuel tank and the thermal insulation means.

9. The apparatus according to claim 1, wherein the heat exchanger is integrated to the thermal insulation means.

10. The apparatus according to claim 1, wherein the canister is a piece separate from the heat exchanger.

11. The apparatus according to claim 10, wherein the canister is a piece separate from the thermal insulation means.

12. The apparatus according to claim 1, wherein the canister is a piece separate from the thermal insulation means.

* * * * *

UNITED STATES PATENT AND TRADEMARK OFFICE

CERTIFICATE OF CORRECTION

PATENT NO. : 7,444,996 B2
APPLICATION NO. : 11/572374
DATED : November 4, 2008
INVENTOR(S) : Vincent Potier It is certified that error appears in the above-identified patent and that said Letters Patent is hereby corrected as shown below:

In the Title page Item [54], change “Vapour” to --Vapor--.

Title page Item [57]
In the abstract, line 9, change “beat” to --heat--.

Column 6, line 43, claim 1 change “pipes” to --pipe--.

Signed and Sealed this

Seventeenth Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,444,996 B2
APPLICATION NO. : 11/572374
DATED : November 4, 2008
INVENTOR(S) : Vincent Potier It is certified that error appears in the above-identified patent and that said Letters Patent is hereby corrected as shown below:

In the Title page Item [54] and Column 1, line 1, change “Vapour” to --Vapor--.

Title page Item [57]
In the abstract, line 9, change “beat” to --heat--.

Column 6, line 43, claim 1 change “pipes” to --pipe--.

This certificate supersedes the Certificate of Correction issued March 17, 2009.

Signed and Sealed this

Seventh Day of April, 2009

JOHN DOLL
*Acting Director of the United States Patent and Trademark Office*